US008770687B2

(12) United States Patent
Ito

(10) Patent No.: US 8,770,687 B2
(45) Date of Patent: Jul. 8, 2014

(54) LIQUID EJECTING APPARATUS

(71) Applicant: Seiko Epson Corporation, Tokyo (JP)

(72) Inventor: Takeshi Ito, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/761,531

(22) Filed: Feb. 7, 2013

(65) Prior Publication Data

US 2013/0208033 A1 Aug. 15, 2013

(30) Foreign Application Priority Data

Feb. 9, 2012 (JP) ..... 2012-026089

(51) Int. Cl.
*B41J 29/38* (2006.01)
*B41J 2/17* (2006.01)

(52) U.S. Cl.
USPC ..... 347/6; 347/84

(58) Field of Classification Search
CPC ..... B41J 29/38; B41J 2/17
USPC ..... 347/5–7, 14, 84, 85
See application file for complete search history.

(56) References Cited

U.S. PATENT DOCUMENTS

| | | | | |
|---|---|---|---|---|
| 5,997,121 | A * | 12/1999 | Altfather et al. | 347/7 |
| 6,012,795 | A * | 1/2000 | Saito et al. | 347/7 |
| 6,361,136 | B1 * | 3/2002 | Watanabe et al. | 347/6 |
| 2004/0130582 | A1 * | 7/2004 | Hanaoka et al. | 347/6 |
| 2013/0201230 | A1 * | 8/2013 | SUGAHARA et al. | 347/6 |

FOREIGN PATENT DOCUMENTS

| | | |
|---|---|---|
| JP | 2008-149646 | 7/2008 |
| JP | 2008-162217 | 7/2008 |
| JP | 2012-192633 | 10/2012 |
| JP | 2012-192668 | 10/2012 |

* cited by examiner

*Primary Examiner* — Kristal Feggins
(74) *Attorney, Agent, or Firm* — Harness, Dickey & Pierce, P.L.C.

(57) ABSTRACT

A liquid ejecting apparatus includes a change detection device detecting a change in a relative position between an ink cartridge and a recording head, and when the change in the relative position exceeds a certain threshold value, a printer controller closes a valve mechanism so that the destruction of a meniscus in the nozzle is prevented.

3 Claims, 6 Drawing Sheets

LIQUID EJECTING APPARATUS

The entire disclosure of Japanese Patent Application No. 2012-026089, filed Feb. 9, 2012 is expressly incorporated by reference herein.

BACKGROUND

1. Technical Field

The present invention relates to a liquid ejecting apparatus such as an ink jet type recording apparatus and to a liquid ejecting apparatus in which a liquid stored in a liquid storage member is introduced into a pressure chamber and the liquid introduced into the pressure chamber is ejected from a nozzle as liquid droplets.

2. Related Art

A liquid ejecting apparatus is an apparatus that includes a liquid ejecting head and ejects various types of liquids from a liquid ejecting head. As the liquid ejecting apparatus, for example, there is an image recording apparatus such as an ink jet type printer (hereinafter, simply referred to as a printer) or an ink jet type plotter.

The liquid ejecting head has been developed which uses a cartridge type liquid storage member, because of ease of handling and distribution. For example, the printer has been widely prevalent which uses an ink cartridge in which a liquid-phase ink is sealed.

FIG. 5 is a schematic view illustrating an ink cartridge 3 as a liquid storage member in which a liquid-phase ink is sealed and a recording head 2 as a type of a liquid ejecting head.

When the ink cartridge 3 is provided in the recording head 2, the ink inside the ink cartridge 3 is introduced into the recording head 2 side via an ink introduction hole 32 opened to a front end side of an ink introduction needle 92 by inserting the ink introduction needle 92 of the recording head 2 into the ink cartridge 3.

The ink introduced into the recording head 2 is introduced into a common liquid chamber 96 (also referred to as a reservoir or a manifold) via an introduction path 95 inside the recording head 2. The ink introduced in the common liquid chamber 96 is supplied to each of a plurality of pressure chambers 98 communicating with the common liquid chamber 96. Then, the pressure inside the pressure chamber 98 is changed by driving a piezoelectric vibrator, a heating element or the like that is a type of a pressure generation unit and the ink is ejected from a nozzle 99 via the pressure chamber 98 by controlling the change in the pressure.

Here, when exchanging the ink cartridge 3 (when the ink cartridge is inserted into the ink introduction needle), there is a case where an excessive positive pressure or an excessive negative pressure may occur inside an ink flow path of the recording head 2 by button operation of an equipment user, change in a relative position occurred between the ink cartridge and the ink introduction needle, impact from the outside, or the like. Then, when the pressure occurred at this time is transmitted to the nozzle 99, a meniscus formed on the nozzle 99 is destroyed.

FIGS. 6A to 6C are enlarged views of the vicinity of the nozzle 99 illustrated in the dashed circle in FIG. 5 and schematic views describing states of a meniscus M in the nozzle 99 when the change in the pressure is transmitted.

A state illustrated in FIG. 6A is an appropriate state, however, there are cases that the meniscus M is excessively drawn into the pressure chamber 98 side from the inner peripheral surface of the nozzle 99 as illustrated in FIG. 6B and the meniscus M is inflated outwards from an opening surface of the ejection side of the nozzle 99 as illustrated in FIG. 6C.

Then, when the pressure in the meniscus M exceeds a withstanding pressure, the meniscus M is not appropriately formed (a destroyed state), the ink may not be ejected, conversely, the ink may be leaked, and then dot failure may occur.

In order to solve such a problem, for example, a differential pressure valve structure has been known in the related art in which a valve is provided inside the ink flow path and the valve is open and closed according to the pressure inside the ink flow path, as disclosed in JP-A-2008-149646.

The structure disclosed in JP-A-2008-149646 is a valve that is configured such that an object of which is to stably supply the liquid to the downstream side by opening the valve in a case where the amount of the liquid at the downstream side is reduced by the liquid normally ejected from the nozzle and the downstream side has a negative pressure. However, there is a case where the valve does not respond to a sudden change in pressure from the impact outside. Thus, when the sudden change in the pressure occurs, the transmission of the change in the pressure to the nozzle may not be prevented and it is difficult to prevent the destruction of the meniscus.

SUMMARY

The invention can be realized in the following forms or application examples.

APPLICATION EXAMPLE 1

According to Application Example 1, there is provided a liquid ejecting apparatus including: a liquid storage member storing a liquid; a liquid ejecting head; a connection section connecting the liquid storage member and the liquid ejecting head; and a change detection device detecting change in a relative position of the liquid storage member with respect to the liquid ejecting head, wherein the change detection device includes a light detection circuit which detects a light emitting section provided in the liquid ejecting head and detects a light emitted from the light emitting section, and an optical member which is provided in the liquid storage member, disposed in a light path between the light emitting section and the light detection circuit and changes an amount of the light incident on the light detection circuit according to movement of the liquid storage member, and the liquid ejecting head includes a pressure chamber which communicates with a nozzle ejecting the liquid, a liquid supply path which supplies the liquid from the connection section to the pressure chamber, and valve mechanism which is provided in the liquid supply path and performs an operation to close the liquid supply path when the light detection circuit detects change in which the amount of the light exceeds a threshold value.

According to Application Example 1, when the liquid ejecting head and the liquid storage member are connected to each other by the connection section or when the impact is added by button operation of a user of the liquid ejecting apparatus or the like, if the relative position between the liquid ejecting head and the liquid storage member is changed, the position of the optical member is also changed, which is disposed in the light path between the light emitting section and the light detection circuit, and changes the amount of the light of the light path according to the movement of the liquid storage member. The amount of the light towards the light detection circuit is changed by the change in the position of the optical member and when the light detection circuit detects the change in which the amount of the light exceeds a threshold value, the valve mechanism closes the liquid supply path. Accordingly, the change in the pressure due to the impact occurred in the vicinity of the connection section can be blocked so as not to be transmitted to the nozzle side and the meniscus formed on the nozzle can be prevented from being destroyed. Accordingly, the liquid ejecting apparatus having less failure of the ejection of the liquid caused by the impact can be obtained.

Here, the threshold value is a value for determining whether or not the change in the pressure causing the destruction of the meniscus occurs in the vicinity of the connection section with the change in the relative position of the liquid storage member with respect to the liquid ejecting head.

APPLICATION EXAMPLE 2

In the liquid ejecting apparatus according to Application Example 1, it is preferable that the liquid ejecting apparatus further includes: a pressure applying element applying the pressure to the pressure chamber, a driving circuit applying the driving signal to the pressure applying element and a central control device transmitting the control signal to the driving circuit, wherein output of the light detection circuit is transmitted to the central control device.

According to Application Example 2, the central control device can obtain the situation of both the driving circuit and the light detection circuit. In other words, the operation of the valve mechanism can be determined by using the information about both the presence or absence of the need of the liquid supply to the current nozzle (whether the driving circuit applying the driving signal to the pressure applying element is operated) and the presence or absence of the need of the blocking of the transmission of the change in the pressure due to the impact (whether the value of the amount of the light detected by the light detection circuit exceeds the threshold value). Accordingly, the valve mechanism is operated more favorably.

APPLICATION EXAMPLE 3

In the liquid ejecting apparatus according to Application Example 1 or 2, it is preferable that the valve mechanism performs an operation to open the liquid supply path, after a lapse of a predetermined time after the operation to close the liquid supply path.

According to Application Example 3, a situation is avoided in which the liquid supply path is remained enclosed when the opening of the liquid supply path is needed after the valve mechanism closes the liquid supply path due to the occurrence of the impact and the ejection of the liquid is stopped. Accordingly, an adverse effect (insufficient liquid supply) due to the liquid ejection in a state where the liquid supply path is remained enclosed is avoided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. In addition, in each of drawings described below, in order to make the size of each layer or each member to a recognizable degree, the scale of each layer or each member is different from the practical scale. Hereinafter, as a liquid ejecting apparatus of the invention, an ink jet type recording apparatus (hereinafter, a printer 1) is described as an example, which has an ink jet type recording head (a type of a liquid ejecting head, hereinafter, it is referred to as a recording head 2).

EMBODIMENT

Figure 1:
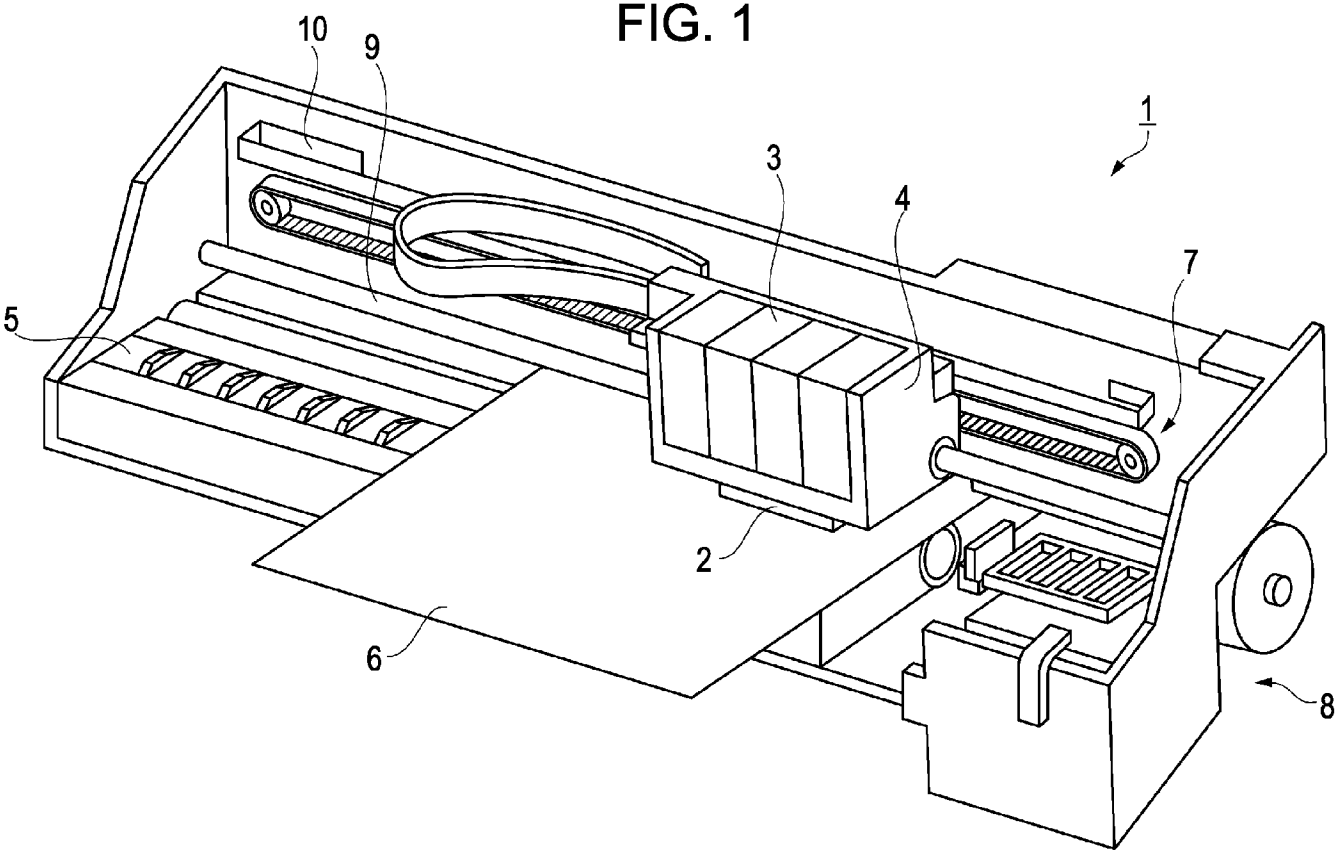
FIG. 1 is a perspective view describing a configuration of a printer in an embodiment.
Figure 2:
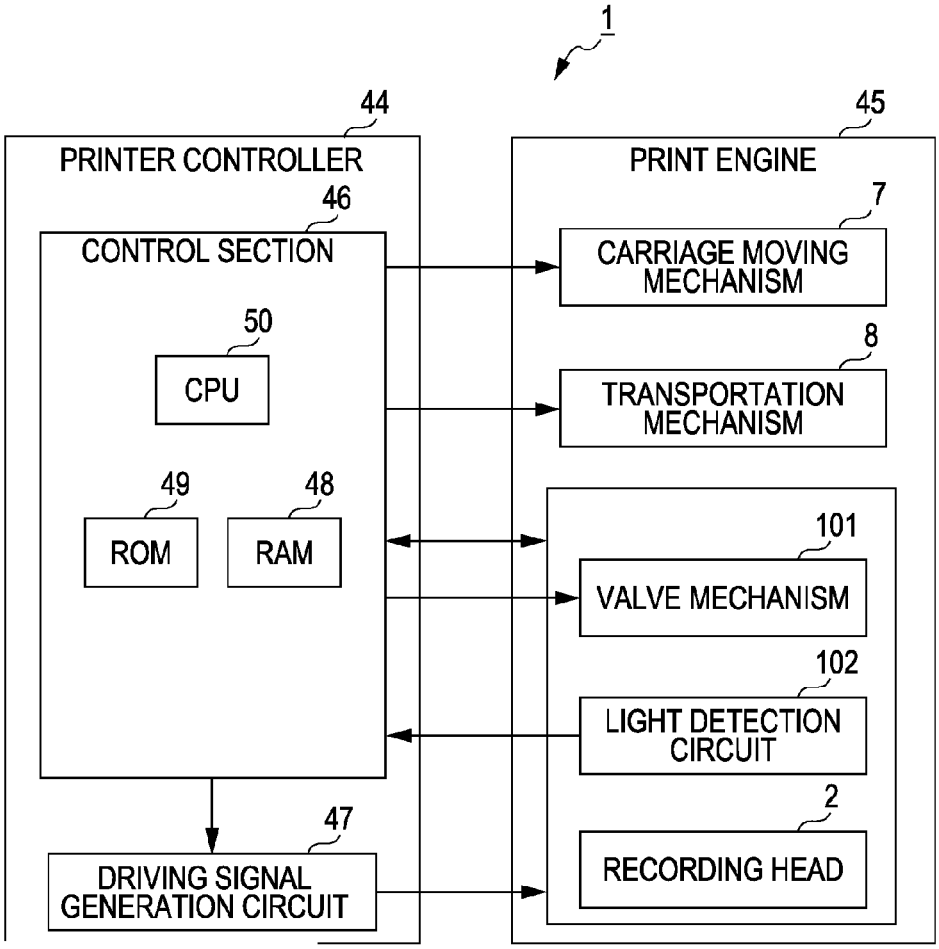
FIG. 2 is a block diagram describing an electrical configuration of the printer.

FIG. 1 is a perspective view describing a configuration of the printer 1. FIG. 2 is a block diagram describing an electrical configuration of the printer 1.

The printer 1 includes a carriage 4 on which the recording head 2 is mounted and an ink cartridge 3 that is a type of a liquid storage member is mounted, a platen 5 supporting a back surface of a recording paper 6 (a type of a recording medium and an impact target) during recording operation, carriage moving mechanism 7 which moves back and forth the carriage 4 in a paper width direction of the recording paper 6, that is, in the main scanning direction, and transportation mechanism 8 which transports the recording paper 6 in a sub-scanning direction orthogonal to the main scanning direction.

The carriage 4 is mounted on a guide rod 9 in a state of being pivotally supported which is bridged in the main scanning direction. In addition, the carriage 4 is configured so as to move in the main scanning direction along the guide rod 9 by the operation of the carriage moving mechanism 7. The position in the main scanning direction of the carriage 4 is detected by a linear encoder 10. The linear encoder 10 is a type of a position information output unit and outputs an encoder pulse according to the scanning position of the recording head 2 as position information in the main scanning direction to a printer controller 44 illustrated in FIG. 2.

A home position which is a reference point of the scanning of the carriage 4 is set at an end portion region of the outside from a recording region within a moving range of the carriage 4. Then, the printer 1 is configured in such a manner that a so-called bi-directional recording is able to be performed in which letters, images, and the like are recorded on the recording paper 6 in the bi-direction when the carriage 4 moves forth from the home position to the end portion of the opposite side and when the carriage 4 moves back from the end portion of the opposite side to the home position.

In FIG. 2, the printer 1 includes the printer controller 44 and a print engine 45. The printer controller 44 includes a control section 46 that is a central control device having a RAM 48 storing various types of data or the like, a ROM 49 storing control program or the like for various control and a CPU 50 performing overall control of each section according to the control program stored in the ROM 49, and a driving signal generation circuit 47 (a type of a driving signal generation unit) as a driving circuit generating the driving signal supplied to the recording head 2. In addition, the print engine 45 includes the recording head 2 illustrated in FIG. 1, the carriage moving mechanism 7, the transportation mechanism 8, valve mechanism 101 and a light detection circuit 102 or the like.

Figure 3A:
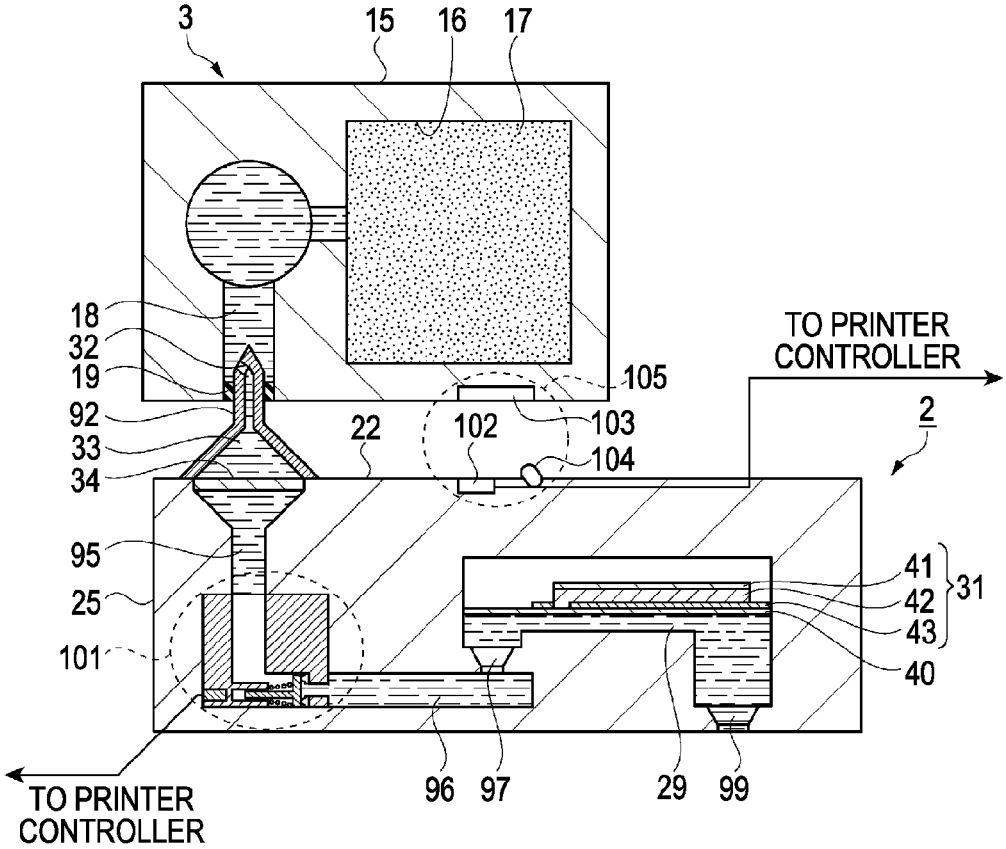
FIGS. 3A to 3C are cross-sectional views schematically illustrating a configuration of an ink cartridge and a recording head, respectively.
Figure 3B:
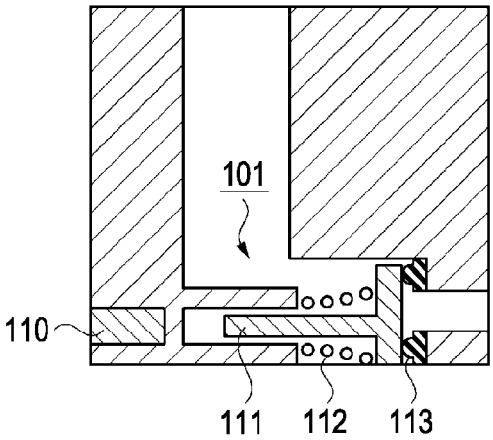
Figure 3C:
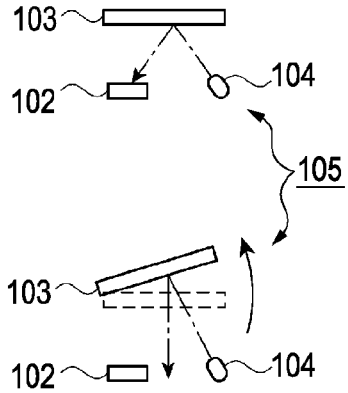

FIGS. 3A to 3C are cross-sectional views schematically illustrating a configuration of the ink cartridge 3 and the recording head 2, respectively. In addition, in the same drawings, a configuration of one line of a nozzle row is illustrated, however, configurations corresponding to the other nozzle rows are the same as the above configuration.

In FIG. 3A, the ink cartridge 3 includes a box-shaped case 15 made by, for example, molding of thermoplastics or the like and an accommodation chamber 16 is formed inside the case 15. The accommodation chamber 16 accommodates an ink holding material 17. The ink holding material 17 absorbs the ink that is a type of a liquid so as to hold the ink. As the ink holding material 17, for example, a sponge-shaped foam material is preferably used.

In addition, a needle insertion section 18 (a type of a connection section to the recording head 2), into which the ink introduction needle 92 of the recording head 2 is inserted, is formed at the bottom surface portion of the ink cartridge 3. A packing 19 is provided at the opening portion of the inner peripheral surface of the needle insertion section 18. When the ink introduction needle 92 is inserted into the needle insertion section 18, the packing 19 comes into close contact with the outer peripheral surface of the ink introduction needle 92 in a liquid-tight state and the ink stored inside the ink cartridge 3 is prevented from leaking to the outside the ink cartridge 3.

The ink cartridge 3 is provided for each type (color) of stored ink. In the embodiment, a total of four (four colors) types of the ink cartridges 3 is configured to be capable of mounting on the recording head 2.

The recording head 2 includes a head case 25 made of a synthetic resin, a cartridge mounting section 22 provided on the upper surface of the head case 25 and the ink introduction needle 92 (a liquid introduction section) erected on the cartridge mounting section 22. In addition, a case flow path 95, an ink flow path as a liquid supply path through a reservoir 96 (a common liquid chamber), an ink supply port 97 (a liquid supply port) and a pressure chamber 29 and a nozzle 99, and a piezoelectric vibrator 31 functioning as a type of a pressure apply element are provided inside the head case 25.

The ink introduction needle 92 is a hollow needle-shaped member whose front end side is formed as a tapered tip shape (a conical shape). In addition, the ink introduction needle 92 is a type of the connection section to the ink cartridge 3. The ink introduction hole 32, in which the ink inside the ink cartridge 3 is introduced, is opened to the front end portion of the ink introduction needle 92. When the ink introduction needle 92 is inserted into the needle insertion section 18 of the ink cartridge 3, the ink stored inside the ink cartridge 3 is introduced in a needle flow path 33 via the ink introduction hole 32. A base end portion (an end portion opposite side of the front end portion) of the ink introduction needle 92 is formed as a conical shape the inner diameter (an internal dimension) of which is gradually expanded from the front end side to the base end side.

The ink introduction needle 92 is welded to be fixed to the peripheral edge portion of the opening upstream the case flow path 95 in the cartridge mounting section 22 in a state where a filter 34 is interposed therebetween. When air bubbles are included in the ink introduced inside the needle flow path 33 of the ink introduction needle 92, the filter 34 captures the air bubbles so that the air bubbles do not transmit to the flow path ahead of the filter 34 and then the ink is supplied to the case flow path 95 side.

A change detection device 105 is configured of the ink cartridge 3 and the recording head 2. The change detection device 105 includes the light detection circuit 102, a light reflecting plate 103 as an optical member and a light emitting section 104.

The light reflecting plate 103 is mounted on the bottom surface (the surface facing the recording head 2) of the case 15 of the ink cartridge 3 at a position facing the light emitting section 104 and the light detection circuit 102 of the recording head 2 in a state of being mounted on the recording head 2.

The light detection circuit 102 is connected to the printer controller 44 illustrated in FIG. 2 and the detected signal is able to be transmitted to the printer controller 44. In particular, the signal is transmitted to the control section 46.

In addition, the detection of the change in a relative position between the ink cartridge 3 including the light reflecting plate 103 and the recording head 2 will be described below. In addition, the ink cartridge 3 is not limited to those illustrated and can use a variety of known configuration.

In FIGS. 2 and 3A, the valve mechanism 101 is mounted between the case flow path 95 and the reservoir 96, and has a configuration that is capable of closing or opening the ink flow path using the control signal from the printer controller 44.

FIG. 3B is a view illustrating a configuration of the valve mechanism 101. The valve mechanism 101 is configured of an electromagnet 110 connected to the printer controller 44, a valve 111 made of magnetic material, a spring 112 and a packing 113. The valve mechanism 101 has the structure such that in a state (a non-conducting state) where a magnetic force is not generated in the electromagnet 110, the valve 111 is pressed against the packing 113 by the spring 112 mounted between the valve 111 and the head case 25 and then the ink flow path is blocked, and in a case where the magnetic force is generated at the electromagnet 110, the valve 111 is attracted to the electromagnet 110 and then the ink flow path is open.

The valve mechanism 101 is provided at the boundary between the case flow path 95 and the reservoir 96 in the embodiment, however, the position is not particularly limited if the valve mechanism 101 is provided between the needle flow path 33 and the nozzle 99. In addition, the valve mechanism 101 is not particularly limited and may use a variety of known configuration if the valve mechanism 101 is a type which is capable of being open or closed by the control signal from the printer controller 44. In addition, operation control of the valve mechanism 101 will be described below.

The ink flowed down the case flow path 95 and passed through the valve mechanism 101 is introduced in the reservoir 96. The reservoir 96 is a common space of a plurality of the pressure chambers 29 and is provided for the type of the ink, that is, for each color of the ink. Each of the pressure chambers 29 communicates with the reservoir 96 via individual ink supply port 97. Accordingly, the ink inside the reservoir 96 is supplied to each of the pressure chambers 29 via the ink supply port 97. The ink supply port 97 is formed having a width that is narrower than the pressure chamber 29 and imparts a flow path resistance to the ink flowing from the reservoir 96 to the pressure chamber 29.

The pressure chamber 29 is formed as an elongated chamber in a direction orthogonal to the arrangement direction (the nozzle row direction) of the row of the nozzle 99. An operation surface 40 as an outer wall having flexibility is provided on the upper surface of the pressure chamber 29. The piezoelectric vibrator 31 is formed on a surface of the operation surface 40 opposite the pressure chamber 29.

The piezoelectric vibrator 31 as the pressure generation unit is, for example, a piezoelectric vibrator of so-called a flexible vibration mode and is configured by pinching a piezoelectric body 42 between a driving electrode 41 and a common electrode 43. When a driving voltage (a driving pulse) is applied to the driving electrode 41 of the piezoelectric vibrator 31, an electric field corresponding to a potential difference is generated between the driving electrode 41 and the common electrode 43. The electric field is given to the piezoelectric body 42 and the piezoelectric body 42 is deformed, according to the strength of the electric field given to the piezoelectric body. In other words, as a potential of the driving electrode 41 gets high, the center portion of the piezoelectric body 42 is deflected to the inside (the nozzle 99 side) of the pressure chamber 29 and the operation surface 40 is deformed so as to decrease the volume of the pressure chamber 29. On the other hand, as the potential of the driving electrode 41 gets lowered (closer to 0), the center portion of the piezoelectric body 42 is deflected to outside the pressure chamber 29 and the operation surface 40 is deformed so as to increase the volume of the pressure chamber 29. In addition, as the pressure generation unit, an electrostatic actuator, a magnetostrictor, a heating element, or the like can be used in addition to the piezoelectric vibrator described above.

A plurality of the nozzles 99 are arranged at the nozzle formation surface and the nozzle row (the nozzle group) is formed. The nozzle row in the embodiment is provided for each type of the ink, that is, for each color of the ink, and a total of four lines of the nozzle rows corresponding to the ink cartridge 3 of each color are formed on the nozzle formation surface. In addition, a configuration may be used in which plurality types of inks are assigned to the same nozzle row.

Then, as described above, when the piezoelectric vibrator 31 is operated, the volume of the pressure chamber 29 can be changed. Accordingly, since the change in the pressure is generated on the ink inside the pressure chamber 29, ink droplets can be ejected from the nozzle 99 using the change in the pressure.

FIG. 3C is a view illustrating a principle of operation of the change detection device 105. An upper view in FIG. 3C illustrates a normal state in which an impact or the like is not added and a lower view illustrates a state where the impact is added to the ink cartridge 3 in an arrow direction of a solid line.

The change detection device 105 is configured in such a manner that the light reflecting plate 103 is mounted on a position facing the light emitting section 104 and the light detection circuit 102 of the recording head 2 in a state of being mounted on the recording head 2, and the light emitting section 104 is disposed having a degree with respect to the light reflecting plate 103.

In the normal state in which the impact or the like is not added, the light emitted from the light emitting section 104 is reflected to the light reflecting plate 103 and comes into contact with the light detection circuit 102, and then the light is detected.

On the other hand, when a certain degree of impact is applied and the ink cartridge 3 is changed with respect to the recording head 2 equal to or more than a certain degree, the light reflected from the light reflecting plate 103 is out of the detection region of the light detection circuit 102 and the light is not detected. In the embodiment, since the impact is determined by whether or not the light is reflected within the width of the light reflecting plate 103, the width of the light reflecting plate 103 is a threshold value (of course, the threshold value can be adjusted by the degree of the light emitting section 104 and the distance between the light emitting section 104 and the light reflecting plate 103).

The detection signal detected by the change detection device 105 is output to the printer controller 44 as the detection signal of the change generation. In other words, it is able to detect the change in the relative position between the ink cartridge 3 and the recording head 2 occurred due to the vibration or the impact applied to the ink cartridge 3 or the recording head 2 when exchanging the ink cartridge or the like.

In the printer 1 having the configuration described above, there are characteristics in that the impact is prevented from being transmitted to the nozzle 99 via the ink flow path by blocking the ink flow path using the valve mechanism 101, when the change in the relative position between the ink cartridge 3 and the recording head 2 detected by the change detection device 105 exceeds a predetermined range. Hereinafter, the characteristics will be described in detail.

If the impact is added when the ink cartridge 3 is provided in the needle connection section, an operator of an equipment operates buttons or the like, it is understood that the change in the relative position occurs between the ink cartridge 3 and the recording head 2, the change thereof is transmitted to the nozzle 99 via the ink introduction hole 32 as the change in the pressure of the ink, and the meniscus is destroyed.

In the printer 1, when the relative position between the ink cartridge 3 and the recording head 2 is changed, the change is detected by the change detection device 105, the signal is transmitted to the printer controller 44 and the control signal is transmitted from the printer controller 44 to the valve mechanism 101 so that the valve mechanism 101 is closed and the change in the pressure transmitted from the ink introduction hole 32 is blocked so as not to be transmitted to the nozzle side.

According to the embodiment, there are following effects.

Since the presence or absence (whether or not the driving signal generation circuit 47 is operated) of the need for supplying the ink from the ink cartridge 3 is able to be grasped in the printer controller 44, the valve mechanism 101 can be always closed if the ink supply is not needed. In the state where the ink supply is needed (the state where the ink is ejected from the nozzle), there are generally only two types, that is, a state of printing and a state of maintenance of the meniscus (a state being said as cleaning and flushing). Thus, in the operation to exchange the ink by a user of the printer or the like where the impact is the most easily added, since the valve mechanism 101 is closed in advance, it is possible to significantly reduce risk that the valve mechanism 101 is not closed in time after the impact more than expected is detected.

In addition, even though the impact is added in a state where the ink supply is needed (in a state where the ink is ejected from the nozzle), since the amount of the ink ejected from the nozzle is able to be grasped in advance (a value that is set in the printer side), the time from the impact to the opening of the valve mechanism 101 is set to be adjusted by the ejection amount. Accordingly, it is possible to lengthen the time for closing the valve mechanism 101 in the range where a problem of supply of the ink being insufficient does not occur. Thus, a risk of remained vibration after the impact can be reduced.

In addition, the invention is not limited to the embodiment described above and is able to have various modifications, based on the disclosure of the claims.

MODIFICATION EXAMPLES

Figure 4A:
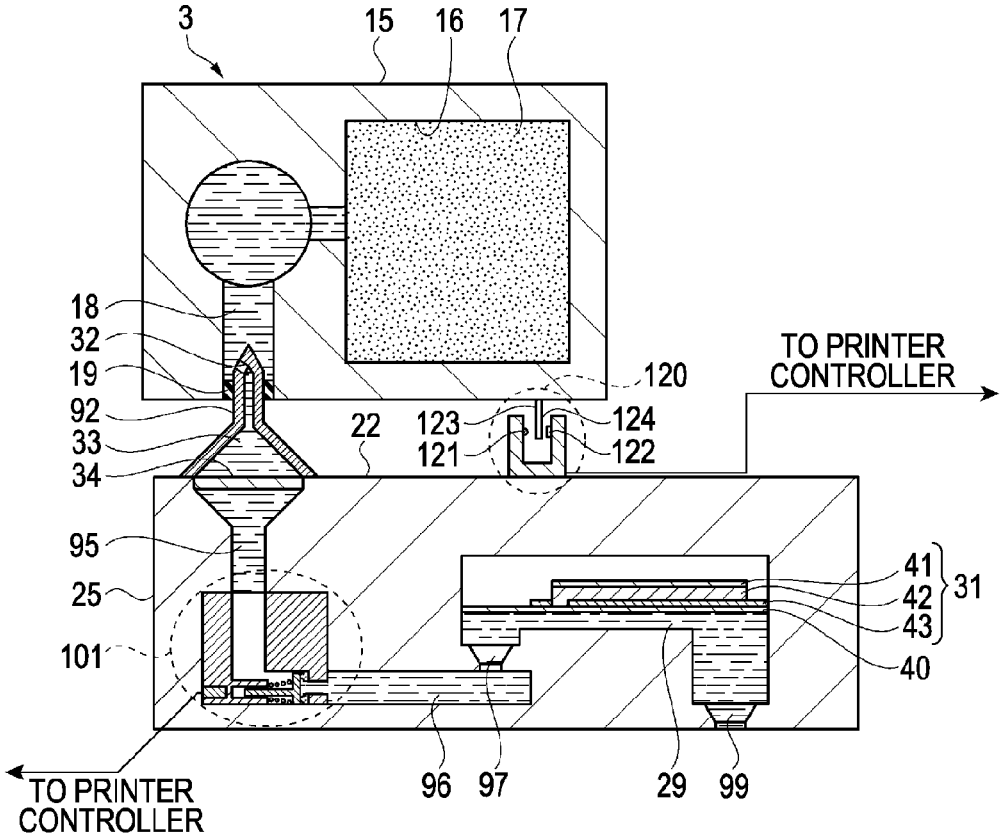
FIGS. 4A and 4B are schematic views describing a configuration of a modification example, respectively.
Figure 4B:
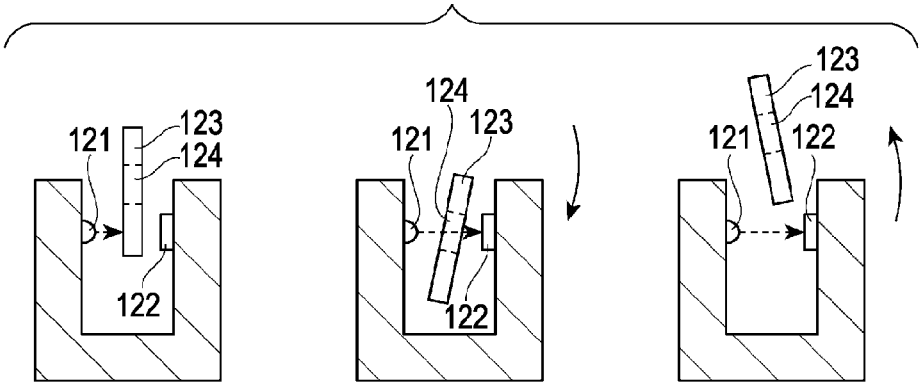
Figure 5:
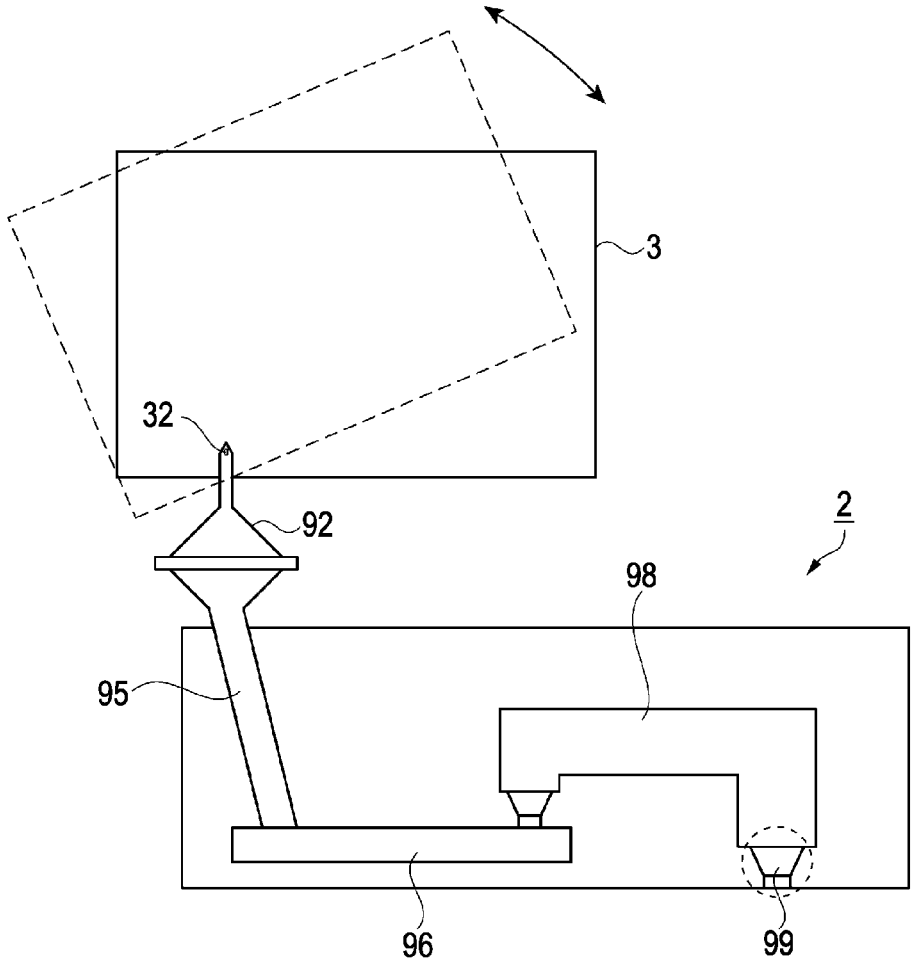
FIG. 5 is a schematic view of an ink cartridge and a recording head.
Figure 6A:
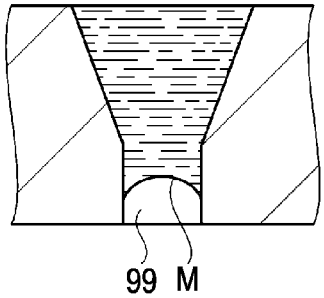
FIGS. 6A to 6C are schematic views describing meniscus states.
Figure 6B:
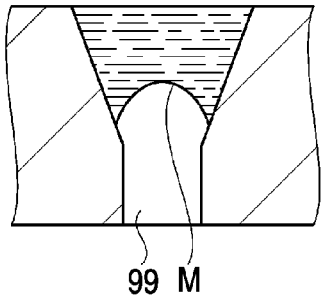
Figure 6C:
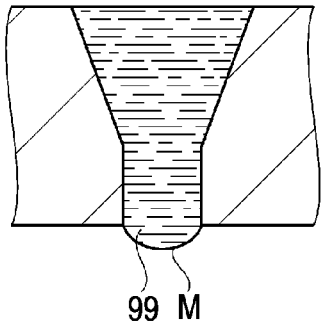

For example, in the embodiment, as the change detection device 105, the reflection type light detection sensor is exemplified, however, the invention is not limited to the embodiment. For example, FIGS. 4A and 4B illustrate schematic views describing a configuration of the modification example. In the modification example illustrated in FIGS. 4A and 4B, as a change detection device 120, a transmission-type light detection sensor is used.

The change detection device 120 includes a light emitting section 121, a light detecting sensor 122 and a shield plate 123 as an optical member.

The light emitting section 121 and the light detecting sensor 122 are mounted on the cartridge mounting section 22. The light detecting sensor 122 is mounted so as to face the light emitting section 121 and the light is always detected.

FIG. 4B is a view illustrating a principle of the operation of the change detection device 120. The left view illustrates a normal state in which the impact or the like is not added, the center view and the right view illustrate states of adding the impact to the ink cartridge 3 in an arrow direction of a solid line.

When mounting the ink cartridge 3, the shield plate 123 mounted on the ink cartridge 3 enters between the light emitting section 121 and the light detecting sensor 122, and blocks the light. When the ink cartridge 3 moves upwards and the impact occurs, the shield plate is shifted upwards, the light is detected by the light detecting sensor 122 and the impact can be detected. In addition, when the ink cartridge 3 moves downwards and the impact occurs, the light passes through a shield plate hole 124 and then the impact can be detected. In this case, the impact is able to be detected as the threshold value being the length of the shield plate downwards from the shield plate hole 124.

In the previous embodiment, the recording head 2 is described as an example, however, if the liquid ejecting head employs the configuration which introduces the liquid from the liquid storage member, the invention is not limited to the recording head 2 described above and the invention may also be applied to a liquid ejecting head mounted on various ink jet type recording apparatuses such as a plotter, a facsimile machine, a copier or the like, a liquid ejecting apparatus in addition to the recording apparatus, for example, a display manufacturing apparatus, an electrode manufacturing apparatus, a chip manufacturing apparatus or the like. Then, in the display manufacturing apparatus, solution of each color material of R (Red), G (Green) and B (Blue) is ejected from a color material ejecting head. In addition, in the electrode manufacturing apparatus, a liquid-phased electrode material is ejected from an electrode material ejection head. In the chip manufacturing apparatus, the invention can be applied to a head or the like which ejects solution of a bioorganic matter from a bioorganic matter ejection head.

What is claimed is:

1. A liquid ejecting apparatus comprising:

a liquid storage member storing a liquid;

a liquid ejecting head;

a connection section connecting the liquid storage member and the liquid ejecting head; and a change detection device detecting change in a relative position of the liquid storage member with respect to the liquid ejecting head, wherein the change detection device includes a light detection circuit which detects a light emitting section provided in the liquid ejecting head and detects a light emitted from the light emitting section, and an optical member which is provided in the liquid storage member, disposed in a light path between the light emitting section and the light detection circuit and changes an amount of the light incident on the light detection circuit according to movement of the liquid storage member, and the liquid ejecting head includes a pressure chamber which communicates with a nozzle ejecting the liquid, a liquid supply path which supplies the liquid from the connection section to the pressure chamber, and valve mechanism which is provided in the liquid supply path and performs an operation to close the liquid supply path when the light detection circuit detects change in which the amount of the light exceeds a threshold value.

2. The liquid ejecting apparatus according to claim 1, further comprising: a pressure applying element applying the pressure to the pressure chamber;

a driving circuit applying the driving signal to the pressure applying element; and a central control device transmitting the control signal to the driving circuit, wherein output of the light detection circuit is transmitted to the central control device.

3. The liquid ejecting apparatus according to claim 1, wherein the valve mechanism performs an operation to open the liquid supply path, after a lapse of a predetermined time after the operation to close the liquid supply path.

* * * * *